US006199224B1

(12) United States Patent
Versland

(10) Patent No.: US 6,199,224 B1
(45) Date of Patent: Mar. 13, 2001

(54) CLEANING SYSTEM FOR HYDROMASSAGE BATHS

(75) Inventor: Anders Versland, Storekvina (NO)

(73) Assignee: Vico Products Mfg., Co., Storkvina (NO)

( * ) Notice: Subject to any disclaimer, the term of this patent is extended or adjusted under 35 U.S.C. 154(b) by 0 days.

(21) Appl. No.: 09/345,005

(22) Filed: Jul. 2, 1999

Related U.S. Application Data

(62) Division of application No. 08/652,423, filed on May 29, 1996, now abandoned.

(51) Int. Cl.[7] ..... A61H 33/02
(52) U.S. Cl. ..... 4/541.4; 4/541.1
(58) Field of Search ..... 4/541.1, 541.4, 4/662

(56) References Cited

U.S. PATENT DOCUMENTS 4,563,781 * 1/1986 James ..... 4/541.4
4,979,245 * 12/1990 Gandini ..... 4/662 X
5,012,535 * 5/1991 Klotzbach ..... 4/541.4 X

* cited by examiner

*Primary Examiner*—Robert M. Fetsuga
(74) *Attorney, Agent, or Firm*—Wallace G. Walter

(57) ABSTRACT

A cleaning system for hydromassage baths of the type that includes a tub having nozzles that introduce a water/air mixture into the tub with a suction opening through which water in the tub is removed for pressurization through a pump and reintroduction into the tub via the nozzles. The system includes water supply piping extending from the pump outlet to the nozzles on each side of the tub to define at least two water circuit portions. In a similar manner, air supply piping that connects to the various nozzles. During a cleaning mode, the water circuit portions are connected to a respective air circuit portion and the air circuit portions are connected to the inlet of the pump to create multiple water/air flow loop through which water and a cleaning agent are passed to effect the desired cleaning.

11 Claims, 12 Drawing Sheets

FIG. 1C
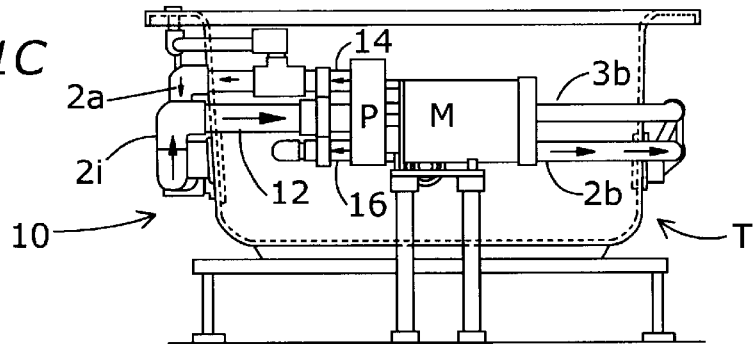
FIG. 1D
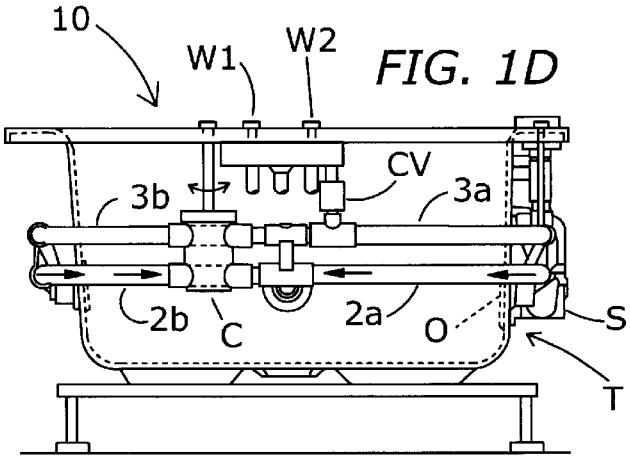
FIG. 1E
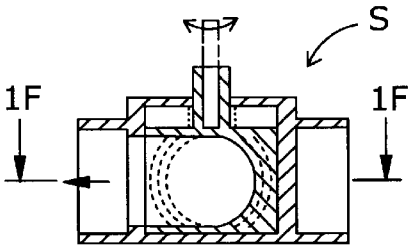
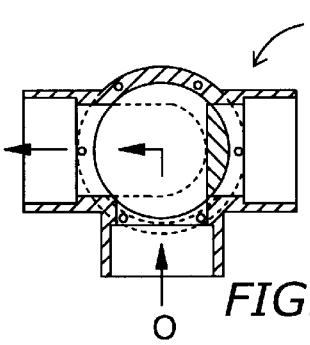
FIG. 1F
FIG. 1G
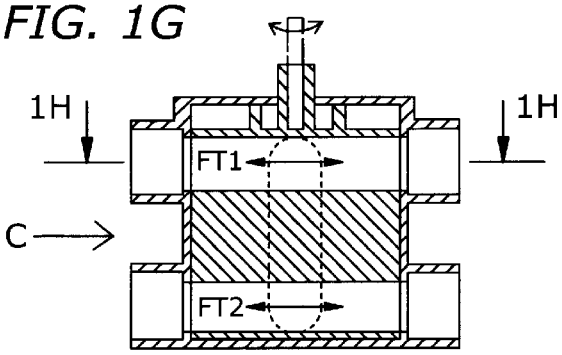
FIG. 1H
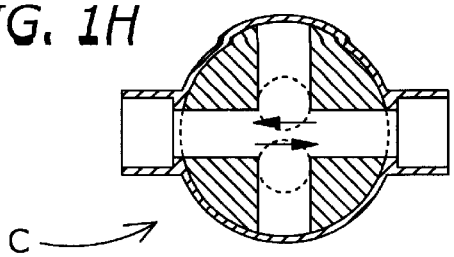
FIG. 1I
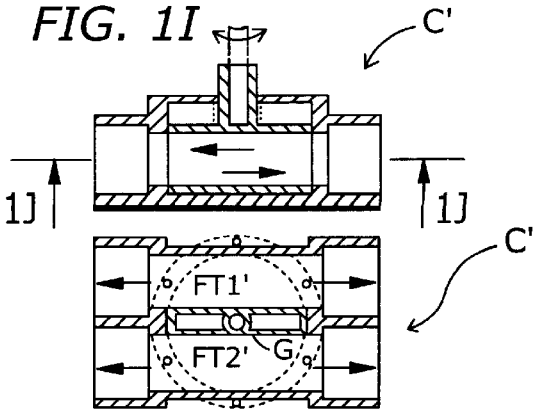
FIG. 1J FIG. 2C
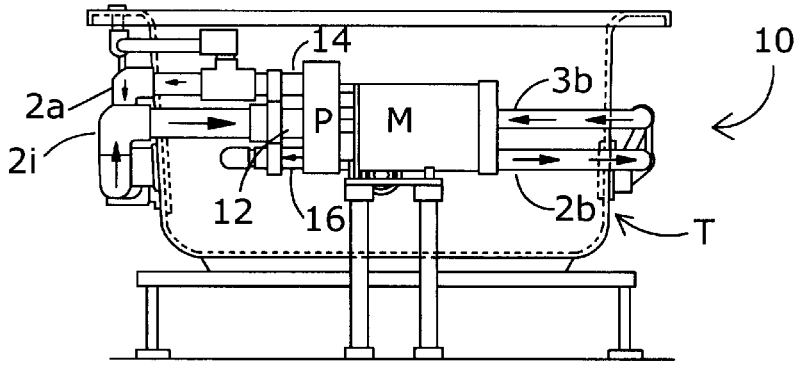
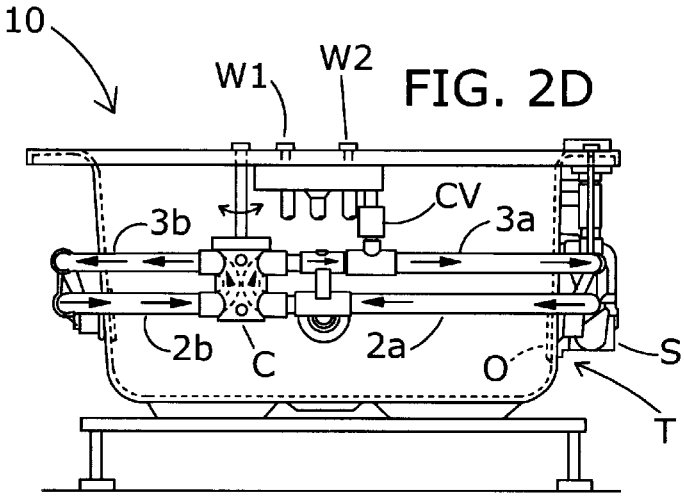
FIG. 2D
FIG. 2E
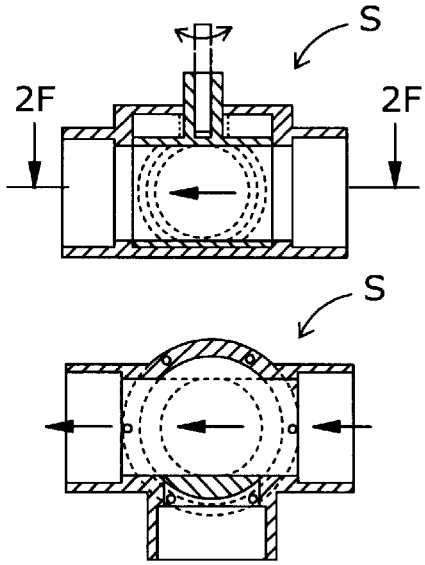
FIG. 2F
FIG. 2G
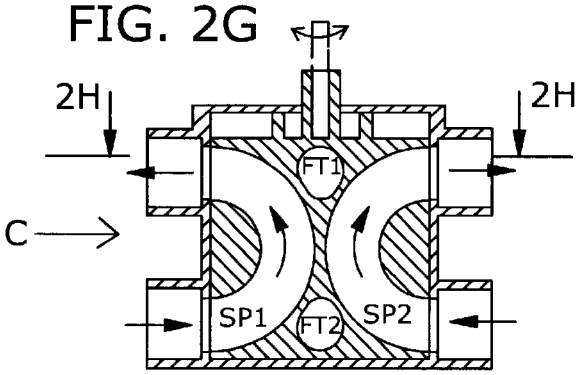
FIG. 2I
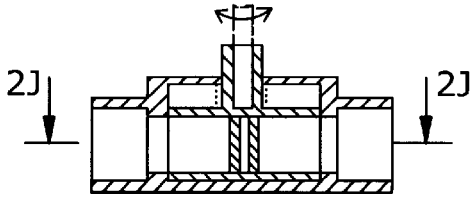
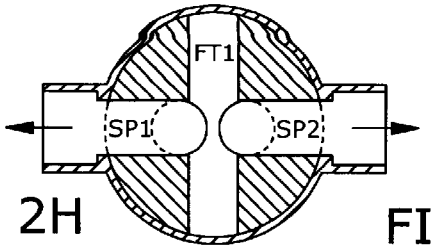
FIG. 2H
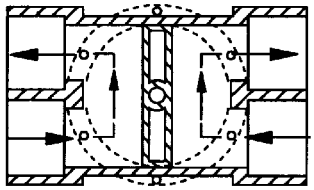
FIG. 2J

CLEANING SYSTEM FOR HYDROMASSAGE BATHS

CROSS REFERENCE TO RELATED APPLICATIONS

This application is a division of U.S. patent application Ser. No. 08/652,423, filed May 29, 1996, abandoned.

BACKGROUND OF THE INVENTION

The present invention relates to a cleaning system for hydro-massage whirlpool baths of the type having a tub structure with a water circuit and an air circuit and one or more nozzles that direct a flow of pressurized water and air into the interior of the tub. In these types of whirlpool baths, a suction opening in the tub removes bath water from the interior of the tub and provides the water to a water pump that pressurizes the water and returns the pressurized water through the water pipe circuit to the nozzles that open into the interior of the tub. The air circuit is provided to mix air with the water to provide water/air jets from each nozzle.

The "water circuit" is defined by the pump and various pipes that convey water from the suction opening in the bath tub in such a way that the water is pressurized before it is conducted back to the nozzles in the wall of the bath tub. In a similar manner, the "air circuit" is defined by the pipes used to convey air from an adjustable air vent to the nozzles, where the air is mixed into the water jet.

The inner walls of the pipes in both the water circuit and the air circuit are liable to the accumulation of fatty deposits and calcium deposits. The air circuit is also subject to undesired deposits because it also becomes filled with water when the bath tub is filled with water and the pump is not turned-on. The growth of bacteria in connection with these deposits is a particular problem when there are many different users, such as in hotels and institutions.

The previous solution to the undesired deposit problem has been for the user to fill the bath tub to its operating level with hot water, pour in a cleaning agent, and then run the system so that the water and cleaning agent were conducted through the various pipes. If stronger cleaning agents or chemicals were used, the user had to thereafter empty the tub, refill the tub, and then run the system once more to rinse away the cleaning agent and/or chemical residues.

These prior cleaning or cleaning/rinsing procedures had the following disadvantages:

1) The complete tub must be filled with water each time the system is to be run to clean/rinse it. The filling of the tub is reflected in the water and power consumption.

2) The cleaning process takes a long time from start to finish and is not suitable for frequent cleaning, e.g., as is desirable in cases of more public uses, such as in hotels or institutions.

3) An unnecessarily large amount of cleaning agent has to be used in order to reach an adequate cleaning solution concentration.

U.S. Pat. No. 4,563,781 to James discloses a cleaning system in which a flow circuit is established during a cleaning mode in which water is pumped through the nozzles from the water circuit to the air circuit for return through a detergent tank into the system pump. The James system, by forcing water through the nozzles, limits the velocity of the flow of the cleaning agent and water through the water circuit and the air circuit.

U.S. Pat. No. 4,979,245 to Gandini discloses a cleaning system that forms a closed circuit which is used during the cleaning mode. The Gandini system uses a water circuit having, to some extent, parallel pipes where pressure differences may arise. The Gandini system thus does not redirect the system to communicate the water circuit with the air circuit in a continuous closed loop. The water flow is not directed through the air circuit directly, but only in parallel and indirectly, if at all, as a consequence of the amount of water which might possibly find a route through the nozzles. The Gandini system is a rather inexpedient way of ensuring that the air circuit is cleaned, since most hydromassage systems will not have substantial water/air passages between the air circuit and the water circuit at the nozzles.

The problem as to the lack of water/air communication between the water and air circuits in the Gandini system is further exacerbated if the uppermost pipe is used for the air circuit, since gravity will tend to keep the water and any cleaning agent in the lower water circuit and out of the uppermost air circuit.

U.S. Pat. No. 5,383,289 to Cleo D. Mathis and J. C. Henry redirects the air circuit and the water circuit so that they are continuous, but does not form a closed circuit that also includes the pump. The Mathis/Henry system is based on rinsing the pipes with water from the user-adjusted hot/cold water mixing unit connected to the air and water circuits system (optionally with added cleaning agent) so that the water constantly flows through the connected water and air circuits and out through the suction opening into the tub. During the cleaning mode of operation in the Mathis/Henry system, the pump is not used to pressurize the water or to increase its flow rate through the pipes. Since the water is not pressurized or the flow rate accelerated, the cleaning is much less efficient.

Further examples of the state of the art are taught in U.S. Pat. No. 4,383,341 to Altman, U.S. Pat. No. 4,868,934 to Altman, U.S. Pat. No. 4,514,868 to Visinand, U.S. Pat. No. 5,012,535 to Klotzbach, and U.S. Pat. No. 5,029,594 to Pierce, Jr.

Thus, there continues to exist a need for a better way to address the bacteria/infection problem described above so that the otherwise inaccessible surfaces are cleaned in a simple and effective manner and to also prevent the growth of bacteria.

SUMMARY OF THE INVENTION

In view of the above, it is an object of the present invention, among others, to provide a cleaning system for hydromassage baths in which the interior surfaces of the air and water circuits are cleaned in a time and cost efficient manner.

It is another object of the present invention to provide a cleaning system for hydromassage baths in which it is possible to clean the interior of the air and water circuits without the necessity to fill the interior of the tub.

The present invention provides a hydromassge tub system having both a hydromassage mode and a cleaning mode by which the interior of the various pipes that define the flow passages can be effectively cleaned. The hydromassage tub system includes a tub having a plurality of nozzles therein for introducing water jets into the interior of the tub and a pump for supplying pressurized water to the nozzles while an air circuit distributes air to the nozzles to be mixed with the water in each nozzle. A first valve is provided for selectively connecting an inlet of the pump to a suction inlet in the tub for accepting water from the interior of the tub in the hydromassage mode and for selectively connecting the pump inlet to the air circuit for accepting water from the air circuit in the cleaning mode. A second valve is provided to selectively connect the water circuit to the air circuit in the cleaning mode. The second valve, when connecting the water circuit to the air circuit in the cleaning mode, defines a first water circuit portion connected to the air circuit and also defines a second water circuit portion connected to the air circuit, the first and second water circuit portions extending in parallel flow from the pump to the air circuit to form multiple water/air flow loops in the cleaning mode.

With the system of the present invention, it is thus possible to fill and run the hydromassage system without filling the interior of the tub. All the pipes, i.e., the air pipes and the water pipes, are involved in the cleaing paths when the system is in its cleaning mode. Moreover, it is possible to use only a small amount of cleaning agent. After the cleaning mode, the pipes can be emptied via the bath tub and the process can optionally be repeated to rinse the system so that it is completely free of chemicals.

In practice, only a few liters of water are required to fill the water and air pipe systems, in contrast to the 100–300 liters needed to fill an entire bath tub to realize a savings in the consumption of water, power, cleaning agent, and time.

Consequently, the water and air piping system can be cleaned frequently and easily, and is especially suitable for use in hotels and institutions. Moreover, the pipe system is simple to manufacture, or, alternatively, incorporate into an existing design by appropriate modification and also requires relatively few special parts. The price the consumer will have to pay will thus be a modest additional amount.

The present invention advantageously provides a cleaning system for hydromassage baths in which the interior surfaces of the pipes that define the air and the water circuits can be efficiently cleaned.

Other objects and further scope of applicability of the present invention will become apparent from the detailed description to follow, taken in conjunction with the accompanying drawings, in which like parts are designated by like reference characters.

BRIEF DESCRIPTION OF THE DRAWING

FIG. 1C is an end view of the whirlpool tub according to FIGS. 1A and 1B showing the pump/motor assembly;

FIG. 1D is an end view of the whirlpool tub according to FIGS. 1A and 1B from the end opposite to that shown in FIG. 1C and showing a shunting valve for selectively connecting water and air circuits during the hydromassage mode;

FIG. 1E is a side elevational view, in cross-section, of a three-port user-adjustable suction valve in a first position corresponding to the hydromassage mode;

FIG. 1F is a cross-sectional view of the user-adjustable suction valve of FIG. 1E taken along line 1F—1F of FIG. 1E;

FIG. 1G is a side elevational view, in cross-section, of the shunting valve connecting corresponding water circuit pipes and corresponding air circuit pipes on the opposite sides of the shunting valve during the hydromassage mode;

FIG. 1H is cross-sectional view of the shunting valve of FIG. 1G taken along line 1H—1H of FIG. 1G;

FIG. 1I is a side elevational view, in cross-section, of an alternate-structure shunting valve;

FIG. 1J is cross-sectional view of the alternate structure shunting valve of FIG. 1I taken along line 1J—1J of FIG. 1I;

FIG. 2C is an end view of the whirlpool tub according to FIGS. 2A and 2B showing the pump/motor assembly during the cleaning mode with water flow in both the water circuit and the air circuit shown by solid-line arrows;

FIG. 2D is an end view of the whirlpool tub according to FIGS. 2A and 2B from the end opposite to that shown in FIG. 2C and showing the shunting valve in a configuration for connecting the water and air circuits to one another during the cleaning mode with water flow in both the water circuit and the air circuit shown by solid-line arrows;

FIG. 2E is a side elevational view, in cross-section, of the three-port user-adjustable suction valve in the second position corresponding to the cleaning mode;

FIG. 2F is a cross-sectional view of the three-port user-adjustable suction valve of FIG. 2E taken along line 2F—2F of FIG. 2E;

FIG. 2G is a side elevational view of the shunting valve of FIG. 2D connecting the water circuit pipe and the corresponding air circuit pipe on each lateral side of the tub during the cleaning mode with water flow in both the water circuit and the air circuit shown by solid-line arrows;

FIG. 2H is cross-sectional view of the shunting valve of FIG. 2G taken along line 2G—2G of FIG. 2H;

FIG. 2I is a side elevational view of the alternate-structure shunting valve of FIGS. 1I and 1J in the cleaning mode;

FIG. 2J is cross-sectional view of the alternate structure shunting valve of FIG. 2I taken along line 2I—2I of FIG. 2J;

DESCRIPTION OF THE PREFERRED EMBODIMENT

Figure 1A:
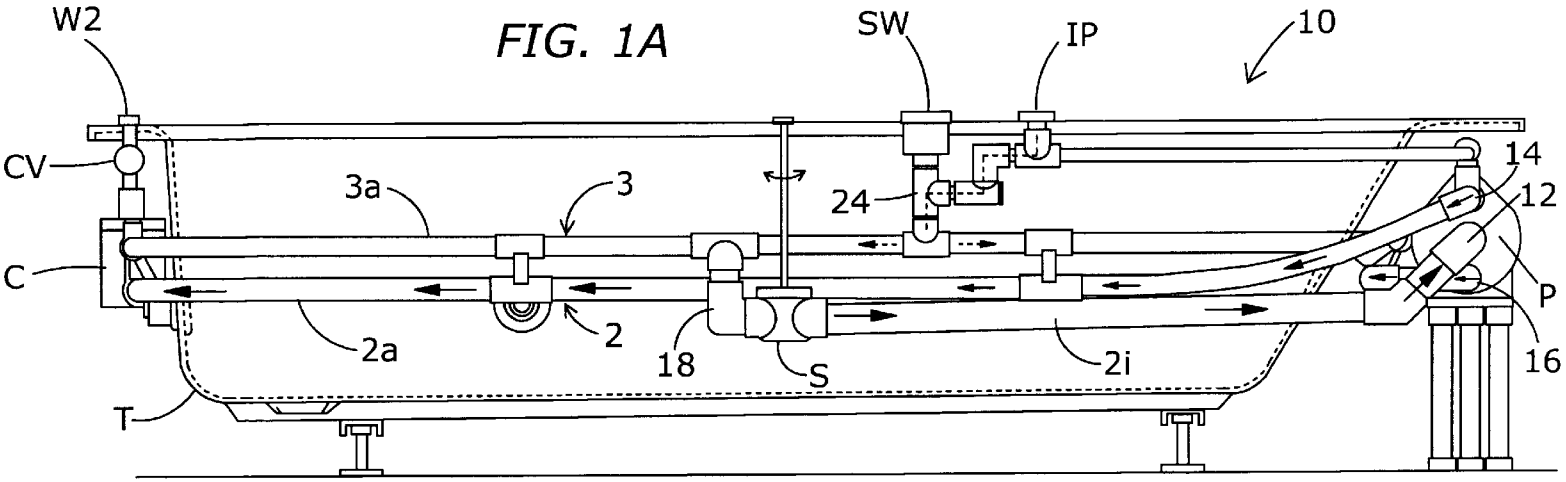
FIG. 1A is a simplified lateral elevational view from one of the longer sides of a whirlpool tub showing the water pipe circuit and the air pipe circuit and related valving during the hydromassage operational mode with solid-line arrows showing the water flow and dotted-line arrows showing air flow.
Figure 1B:
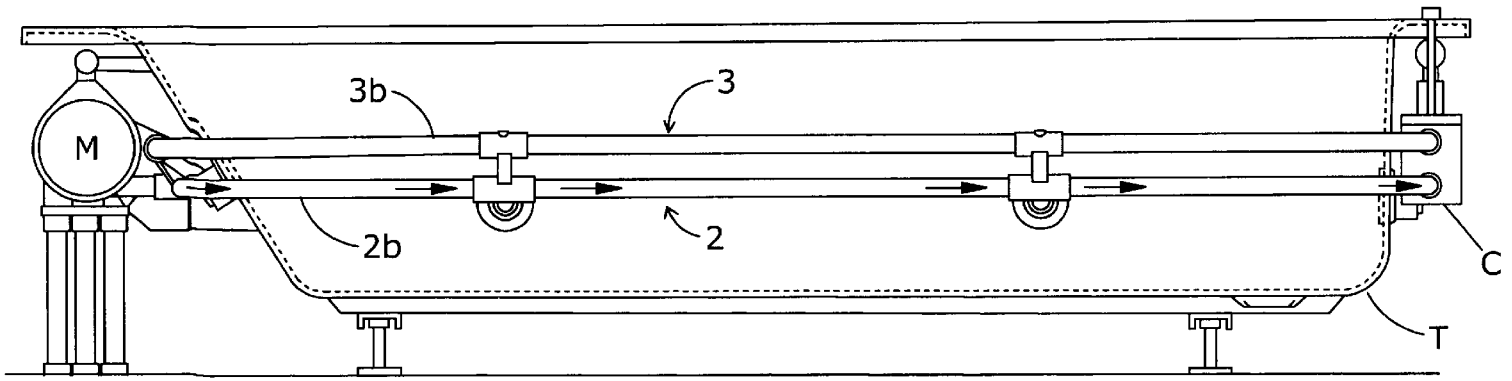
FIG. 1B is a simplified lateral elevational view from the longer side of the whirlpool tub on the side opposite from that shown in FIG. 1A showing the water pipe circuit and the air pipe circuit during the hydromassage operational mode with solid-line arrows showing the water flow.

A hydromassage tub system, generally indicated by the reference character 10, incorporating a preferred embodiment of a cleaning system for hydromassage tubs in accordance with the present invention, is shown in FIGS. 1A–1J in a hydromassage configuration and in FIGS. 2A–2J in a cleaning configuration. In both sets of figures, the bath or tub structure is designated generally therein by the reference character T. As is conventional in this art, a plurality of nozzles, generally indicated by the reference character N, are mounted in sidewalls of the tub T. The nozzles N are connected to below described water and air circuits to each introduce a pressurized stream of air and water into the interior of the tub T. As is conventional in the art, the nozzles N are of the type that can be individually opened and closed by the user.

Water is initially introduced into the interior of the tub T through a water mixing unit or battery (FIG. 1D) that includes conventional user-adjusted hot and cold water taps W1 and W2. The water enters the air circuit 3 through a short pipe (unnumbered) extending from the water mixing unit through an approved check valve CV and flows through the opened nozzles N into the interior of the tub T.

A suction opening 0 (shown in dotted-line illustration in FIG. 1D and better shown in FIG. 3A) is provided in the interior of the tub T in the conventional manner and through which water is withdrawn from the interior of the tub T during the hydromassage mode.

A water distribution circuit, generally indicated by the reference character 2 and an air distribution circuit, generally indicated by the reference character 3, are both connected to each of the nozzles N. The air circuit 3 is positioned generally above the water circuit 2. The direction of water flow in the water circuit 2 during the hydromassage mode of operation (FIGS. 1A–1D) and in the water and the air circuits during the cleaning operational mode (FIGS. 2A–2D) are indicated by the solid-line arrows. The water circuit 2 is further sub-divided into a water circuit portion 2*a* (FIG. 1A) on one side of the tub T and a water circuit portion 2*b* (FIG. 1B) on the opposite side of the tub T. In a similar manner, the air circuit 3 is sub-divided into an air circuit portion 3*a* (FIG. 1A) on one side of the tub T and another air circuit portion 3*b* (FIG. 1B) on the opposite side of the tub T.

The system 10 includes a motor M coupled to a pump P (FIG. 1C) to define a motor/pump assembly as is conventional in this art. The pump P includes (FIG. 1A) a centrally located inlet 12, an upper pump outlet 14, and a lower pump outlet 16. As best shown in FIG. 1A, the water circuit portion 2*a* is connected to the upper pump outlet 14 while the water circuit portion 2*b* on the opposite side of the tub T is connected to the lower pump outlet 16.

A shunting valve C is located at the end of the tub T opposite that of the pump P and is connected to the water circuit 2 and to the air circuit 3. As explained more fully below, the shunting valve C is user-adjustable to one position during the hydromassage operational mode and another position during the cleaning operational mode. During the hydromassage mode, the shunting valve C places the water circuit portions 2*a* and 2*b* on the opposite sides of the tub T in flow communication with each other and also places the air circuit portions 3*a* and 3*b* on the opposite sides of the tub T in flow communication with each other. During the cleaning operational mode, the shunting valve C is adjusted to place the water and the air circuit portions on each side of the tub T in flow communication, i.e., the water circuit portion 2*a* is placed in flow communication with the air circuit portion 3*a* on the one side of the tub T and, similarly, the water circuit portion 2*b* on the other side of the tub T is placed in flow communication with the air circuit portion 3*b* on the other side of the tub T. The shunting valve C is operated to its hydromassage position or to its cleaning mode by a control shaft or rod (FIG. 1D, unnumbered) that extends above the shunting valve C and terminates in a knob (unnumbered) above the sill of the tub T.

As shown in the detail views of FIGS. 1G, 1H, 2G, and 2H, the shunting valve C includes upper ports on its opposite sides for insertion into the air circuit 3 and lower ports on its opposite sides for insertion into the water circuit 2. The shunting valve C includes two separate sets of internal flow passages. As shown in FIGS. 1G and 1H, the shunting valve C includes through-flow passages FT1 and FT2 that connect, respectively, the air portions 3*a* and 3*b* and the water circuit portions 2*a* and 2*b* on the opposite sides of the tub T. In the hydromassage configuration of FIGS. 1G and 1H, the water circuit portions 2*a* and 2*b* are in flow communications with each other through the passage FT2, and the air circuit portions 3*a* and 3*b* are in fluid communication with each other through the passage FT1. As shown more clearly in FIGS. 2G and 2H, the shunting valve C also includes shunt-flow passages SP1 and SP2 that connect, during the cleaning mode, the water circuit and the air circuit portions on each side of the tub T. More specifically, the curved shunt passage SP1 is effective to provide flow communication between the water circuit portion 2*b* and the air circuit portion 3*b* on the left in FIG. 2D, and, in a similar manner, the curved shunt passage SP2 is effective to connect the water circuit portion 2*a* with the corresponding air circuit portion 3*a* on the right side of the tub T as shown in FIG. 2D. In the configuration of FIGS. 2G and 2H, the water circuit 2 and the air circuit 3 are effectively interrupted at the shunting valve C and connected to each other on the same side of the tub T during the cleaning mode.

A user-adjustable three-port suction valve S is located on one side (FIG. 1A) of the tub T and is connected to the suction opening 0 in the interior of the tub T, connected to the air circuit 3 through a short branch pipe 18, and connected to the pump inlet 12 through a water inlet pipe 2*i*. As explained more fully below, the suction valve S is user-adjustable to one position during the hydromassage operational mode and another position during the cleaning operational mode. During the hydromassage mode, the suction valve S places the suction opening 0 in flow communication with the pump inlet 12 so that water will flow from the suction inlet 0 through the water inlet pipe 2*i* into the pump inlet 12. During the cleaning mode, the suction valve S places the air circuit 3 in flow communication with the pump inlet 12 so that, as explained more fully below, water and cleaning agent in the air circuit 3 will flow from the air circuit 3 through the branch pipe 18 and the water inlet pipe 2*i* into the pump inlet 12. The suction valve S is operated to its hydromassage position or to its cleaning mode by a control shaft or rod (FIG. 1A, unnumbered) that extends above the suction valve S and terminates in a knob (unnumbered) above the sill of the tub T. Thus, by appropriate adjustment of the suction valve S, the user can connect the interior of the tub T to the pump inlet 12 during the hydromassage mode or connect the air circuit 3 (through the branch pipe 18) to the pump inlet 12 during the cleaning mode.

The system 10 is switched on or off using a conventional air-impulse switch SW (FIG. 1A) that is connected to the air circuit 3 through a short extension 24.

The system 10 includes an air-control/cleaning-agent-fill valve/port IP (FIG. 1A). During the hydromassage mode, the air-control/cleaning-agent-fill valve/port IP can be adjusted by the user to control the amount of ambient air that is introduced into the air circuit 3 for entrainment in the water flow through the various nozzles N. During the cleaning mode, the air-control/cleaning-agent-fill valve/port IP is used by the user to introduce a cleaning agent into the water that is circulated by the pump P through both the water circuit 2 and the air circuit 3.

During the hydromassage operational mode, the bath tub T is filled with water from the water supply using the taps W1 and/or W2 (FIGS. ID). The shunt valve C is adjusted as shown in FIGS. 1D, 1G, and 1H so that air and water circuits form respective continuous flow loops as discussed above. In addition, the suction valve S is adjusted as shown in FIGS. 1E and 1F so that the suction inlet 0 is in flow communication with the pump inlet 12 through the water inlet pipe 2*i*. When the level of water in the tub T is deemed suitable, the motor M turned ON using the air-impulse switch SW. The water in the tub T is removed through the suction opening 0 and passed through the suction valve S into the water inlet pipe 2*i* of the water circuit 2 and into the inlet 12 of the pump P. The pressurized water from the upper pump outlet 14 of the pump P is passed through the water circuit portion 2*a* (FIG. 1B) while the pressurized water from the lower pump outlet 16 of the pump P is passed through the water circuit portion 2*b*. The pressurized water passes through the various nozzles N and also entrains air from the air circuit 3 to introduce jets of air-entrained pressurized water into the interior of the tub T in the usual manner.

The user controls the introduction of ambient air into the system by appropriate adjustment of the air-control/cleaning-agent-fill valve/port IP. As indicated by the dotted-line arrows in FIG. 1A, the air flows from the air-control/cleaning-agent-fill valve/port IP through various extensions into the pipe 24 and into the air circuit 3 for distribution to the various nozzles N as is conventional.

Since the shunting valve C is in the position shown in FIG. 1D during the hydromassage mode of operation, the air circuit portions 3*a* and 3*b* and the water circuit portions 2*a* and 2*b* on the opposite side of the tub T are in respective flow communication through the flow-through passages FT1 and FT2 of shunting valve C.

The shunt valve C shown in FIGS. 1G, 1H, 2G, and 2H is the preferred form; however, other valve configurations are likewise suitable. For example and as shown in FIGS. 1I, 1J, 2I, and 2J, a rotatable gate-type valve C' is likewise suitable. As shown in FIGS. 1I and 1J, the valve C' is configured to define passages FT1' and FT2' in a manner similar to flow-through passages FT1 and FT2 of FIGS. 1G and 1H; the passages FT1' and FT2' provide through-flow for the water circuit 2 and the air circuit 3. When the shunt valve C' is configured for the cleaning mode by appropriate rotation of its control shaft (FIG. 1I, unnumbered), an internal partition or gate G is rotated to configure the valve C' to the cleaning mode and, as shown in FIG. 2I and 2J, flow communication across the valve C' for the water circuit 2 and for the air circuit 3 is interrupted and the water circuit portion 2*b* on one side of the tub T is placed in flow communication with the air circuit portion 3*b* on the one side of the tub T and, in a similar manner, the water circuit portion 2*a* on the other side of the tub T is placed in flow communication with the air circuit portion 3*a* on the other side of the tub T.

Figure 2A:
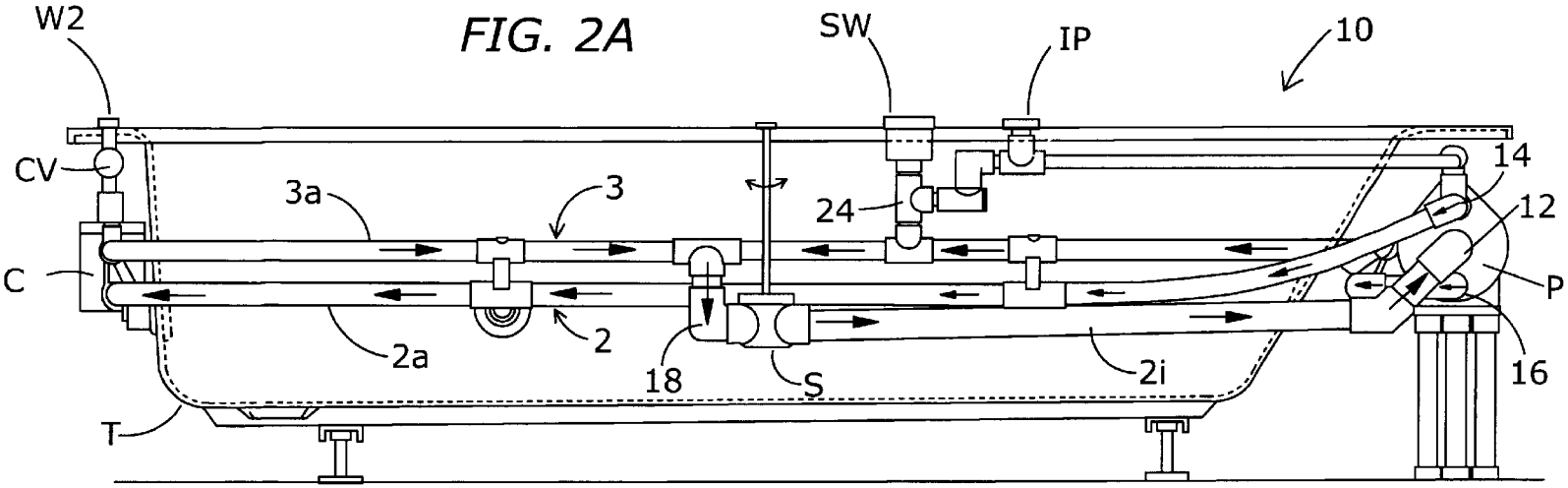
FIG. 2A is a simplified lateral elevational view from the side of the hydromassage whirlpool tub corresponding to FIG. 1A and showing the water pipe circuit and the air pipe circuit and related valving during the cleaning mode with water flow in both the water circuit and the air circuit shown by solid-line arrows.
Figure 2B:
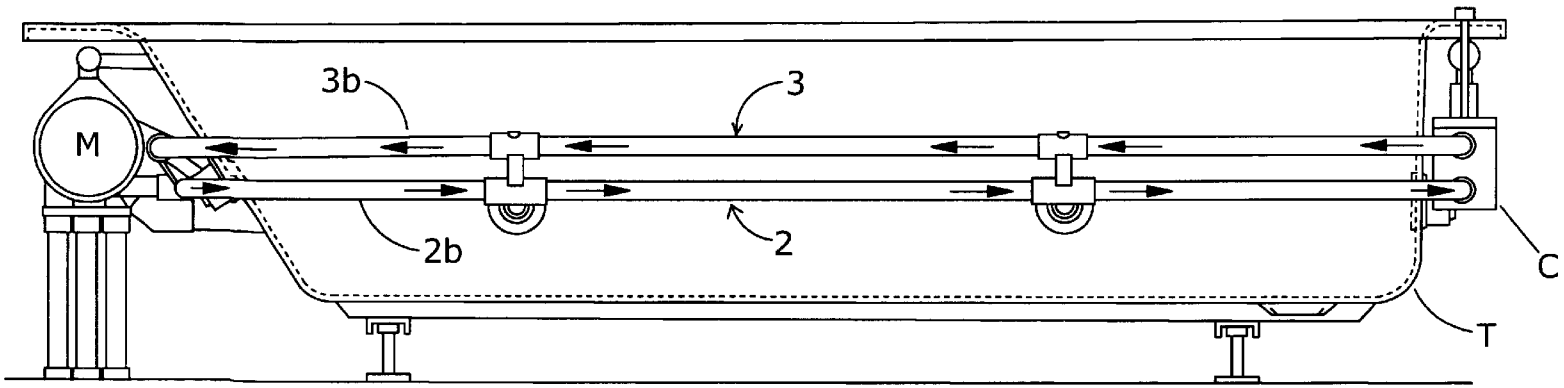
FIG. 2B is a simplified lateral elevational view of the longer side of the hydromassage whirlpool tub corresponding to FIG. 2A showing the water pipe circuit and the air pipe circuit during the cleaning mode with water flow in both the water circuit and the air circuit shown by solid-line arrows.

During the cleaning operation cycle or mode and as shown in FIGS. 2A–2H, the nozzles N are closed and the suction valve S adjusted so that the suction opening 0 is closed and flow communication established between the air circuit 3*a* (via the extension 18) and the water inlet pipe 2*i* of the water circuit 2. Additionally, the shunting valve C is adjusted to the position shown in FIGS. 2G and 2H to interrupt the water circuit 2 and the air circuit 3 and establish flow communication between the water circuit portion 2*a* and the air circuit portion 3*a* on one side of the tub T (FIG. 2A) and establish flow communication between the water circuit portion 2*b* and the air circuit portion 3*b* on the other side of the tub T (FIG. 2B).

Water is introduced into the piping via the water supply taps W1 and W2 in the same manner as for the hydromassage mode of operation, although the water does not fill the tub T since the nozzles N are closed. When the level of fill water is such that water can be observed in the air-control/cleaning-agent-fill valve/port IP to indicate that the pipes of the air circuit 3 and the water circuit 2 are substantially filled with water, an appropriate amount of cleaning agent is introduced into the water through the air-control/cleaning-agent-fill valve/port IP. The air-control/cleaning-agent-fill valve/port IP is then closed completely and the system is switched on by pressing the air-impulse switch SW. As shown by the solid-line arrows in FIG. 2A, the motor M drives the pump P to direct pressurized water from the upper pump outlet 14 through the water circuit portion 2*a* through the shunting valve C where the water is shunted in the shunting valve C into air circuit portion 3*a*. Part of the water flow in the air circuit 3*a* passes through the branch pipe 18 to the water inlet pipe 2*i* to the pump inlet 12 for recirculation. Concurrently and as shown by the solid-line arrows in FIG. 2B, the pump P also directs pressurized water from the lower pump outlet 16 through the water circuit portion 2*b* and to the shunting valve C where the water is shunted to the air circuit portion 3*b* and then to air circuit 3*a* on the opposite side of the tub T to the extension 18 for return via the extension 18 to the water inlet pipe 2*i* to the pump inlet 12.

As can be appreciated, the water gains substantial velocity through both the pipes of the connected water circuit and the air circuit portions (i.e., 2*a* and 3*a* and 2*b* and 3*b*) with all the pipes included in the cleaning circuit as indicated by the solid-line arrows of FIGS. 2A–2G showing the various flow directions. It is advantageous if all the pipes are of the same dimension in order to avoid points of increased/decreased flow resistance.

As an example, the system can be run for approximately 2 to 3 minutes before operation is halted. Thereafter the pipes are emptied by opening the suction opening 0 by means of the three-port valve S and/or by opening the nozzles N.

The process may be repeated with clean water to rinse the pipe circuits 2 and 3 of any residual cleaning agent.

The embodiment of FIGS. 1A–1D and 2A–2D can be viewed as a double-loop system in the cleaning mode in the sense that the air and water circuits on the opposites of the tub T are reconfigured by the shunting valve C as a first loop (water circuit portion 2*a* and air circuit portion 3*a*) on one side of the tub T and as a second loop (water circuit portion 2*b* and air circuit portion 3*b*) on the other side of the tub T.

Figure 3A:
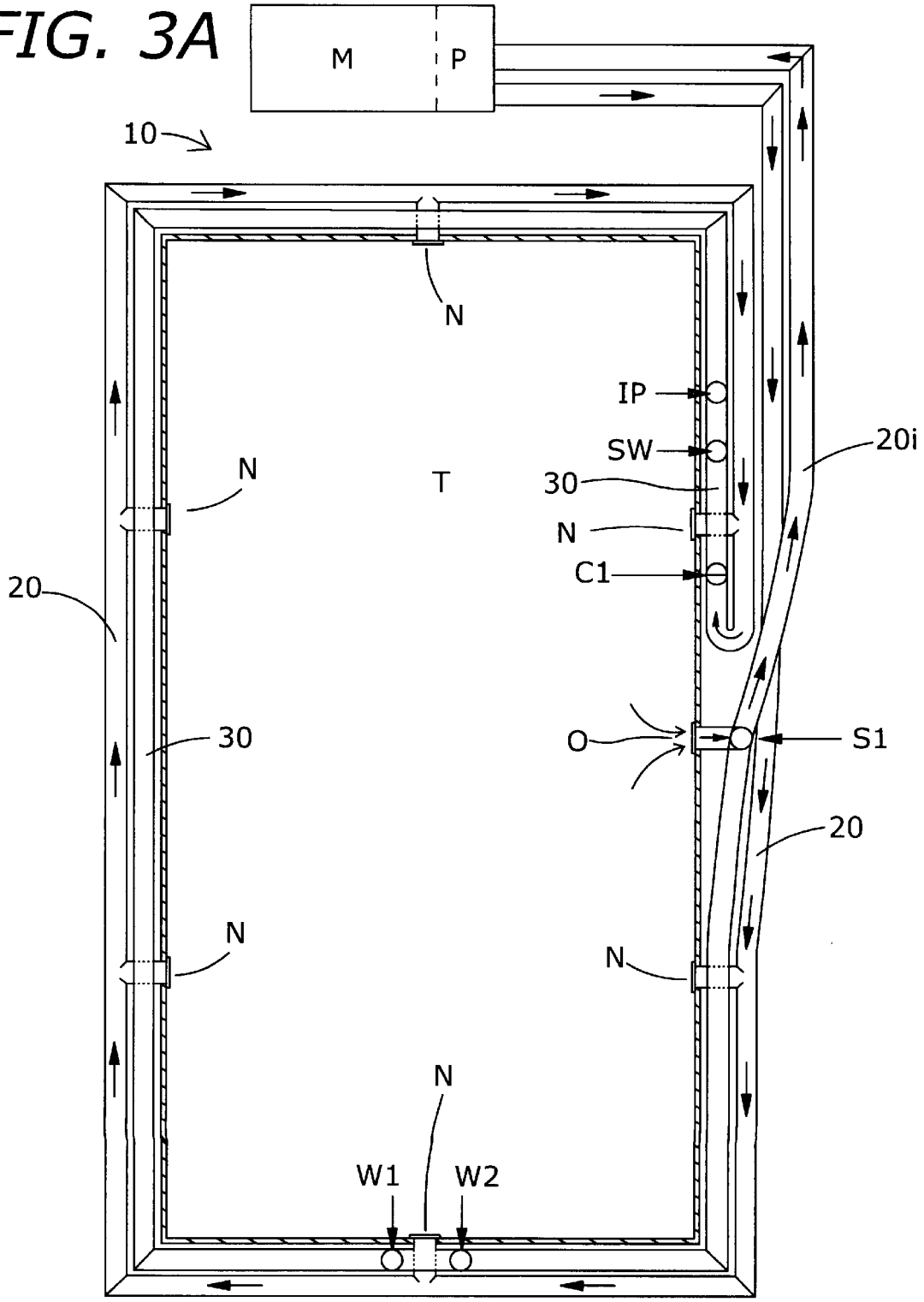
FIG. 3A is a schematic plan-view illustration of a flow diagram for a hydromassage whirlpool tub with appurtenant water pipe circuit and air pipe circuit during a hydromassage operation with water flow shown by solid-line arrows.
Figure 3B:
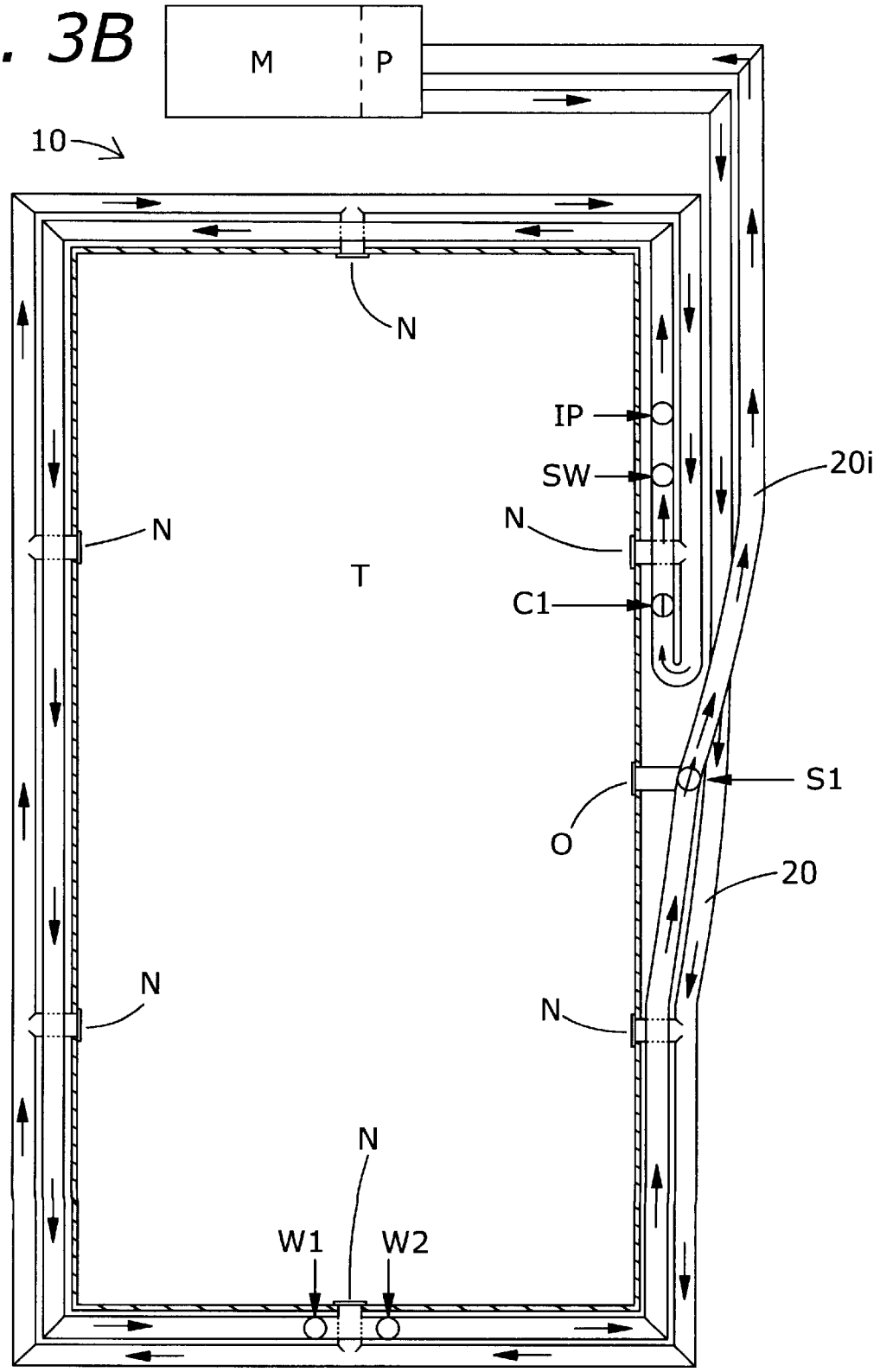
FIG. 3B is a schematic illustration of a flow diagram of the hydromassage whirlpool tub of FIG. 3A with the appurtenant water pipe circuit and air pipe circuit during a cleaning mode with water flow in both the water circuit and the air circuit shown by solid-line arrows.

FIGS. 3A and 3B show schematically a flow diagram in a single-loop embodiment in which the hydromassage configuration is shown in FIG. 3A and the cleaning mode is shown in FIG. 3B.

In the system of FIGS. 3A and 3B, a simple open/close valve C1 is interposed between the end of the water circuit and the beginning of the air circuit. More specifically, the water circuit, generally indicated by the reference character 20, includes a portion 20*i* that leads from a suction valve S1 into the inlet (unnumbered) of the pump P and an another water circuit portion 20 that leads from the pump outlet (unnumbered) around the right side, lower edge, left side, and the upper edge of the tub T and terminates on the right side of the tub T at the open/close valve C1. The air circuit, generally indicated by the reference character 30, starts on the side of the open/close valve C1 opposite the water circuit 20 and extends around the tub T on the right side, the upper edge, the left side, the lower edges and the right side of the tub T terminating at the suction valve S.

The suction valve S1 functions in a manner analogous to the suction valve S1 of FIGS. 1 and 2, that is, the suction valve S is adjustable between a first position in which the suction inlet 0 is connected to the water inlet pipe 20*i* (during the hydromassage mode) and a second position in which the air circuit 30 is connected to the water inlet pipe 20*i* through the appropriately adjusted suction valve S1.

In the hydromassage mode of FIG. 3A, the open/close valve C1 is closed to separate the water circuit 20 from the air circuit 30 and the suction valve S1 (analogous to that shown in FIGS. 1E and 1F) is configured to allow water from the tub T to pass through the suction opening 0 and the water inlet pipe 20*i* into the inlet of the pump P while closing communication between the air circuit 30 and the water inlet pipe 20*i* of the water circuit 20 to the pump P. As shown by the solid-line arrows in FIG. 3A, water under pressure exits the pump P and is conducted via the piping of the water circuit 20 along the right side of the tub T (as viewed in FIG. 3A), across the bottom edge, along the left side of the tub T, across the top side of the tub T, and along the right side of the tub T to the closed valve C1. The water is mixed with air from the air circuit 30 in each of the nozzles N and then jetted into the tub T as is known in the art. Water in the tub T is sucked into and through the suction opening 0 where it is returned to the inlet of the pump P for continued recirculation.

In the cleaning mode of FIG. 3B, the valve C1 is opened to allow flow from the water circuit 20 into the air circuit 30, and the valve S is configured to block flow from the suction inlet 0 and allow flow between the air circuit 30 and the inlet of the pump P through the water inlet pipe 20*i*. As in the case of the embodiment of FIGS. 1 and 2, the nozzles N are closed and water is introduced into the piping via the water supply taps W1 and W2 in the same manner for the hydromassage mode of operation, although the water does not fill the tub T since the nozzles N are closed. When the level of fill water is such that water can be observed in the air-control/cleaning-agent-fill valve/port IP to indicate that the pipes of the air circuit 30 and the connected (through open valve C1) water circuit 20 are substantially filled with water, an appropriate amount of cleaning agent is introduced into the water through the air-control/cleaning-agent-fill valve/port IP. Thereafter, the air-control/cleaning-agent-fill valve/port IP is closed completely and the system is switched ON by pressing the air-impulse switch SW. As shown by the solid-line arrows in FIG. 3B, the motor M drives the pump P to direct pressurized water from the pump outlet in a clockwise direction around the tub T perimeter and through the open valve C1. The water/cleaning agent mix then passes around the perimeter of the tub T in the air circuit 30 and through the suction valve S1 into the water inlet pipe 20*i* of the water circuit and into the pump P for continued recirculation.

As can be appreciated from FIGS. 3A and 3B, the valve C1 selectively connects the water circuit to the air circuit to allow flow therein while the valve S1 selectively connects the air circuit to the inlet of the pump P.

Figure 4A:
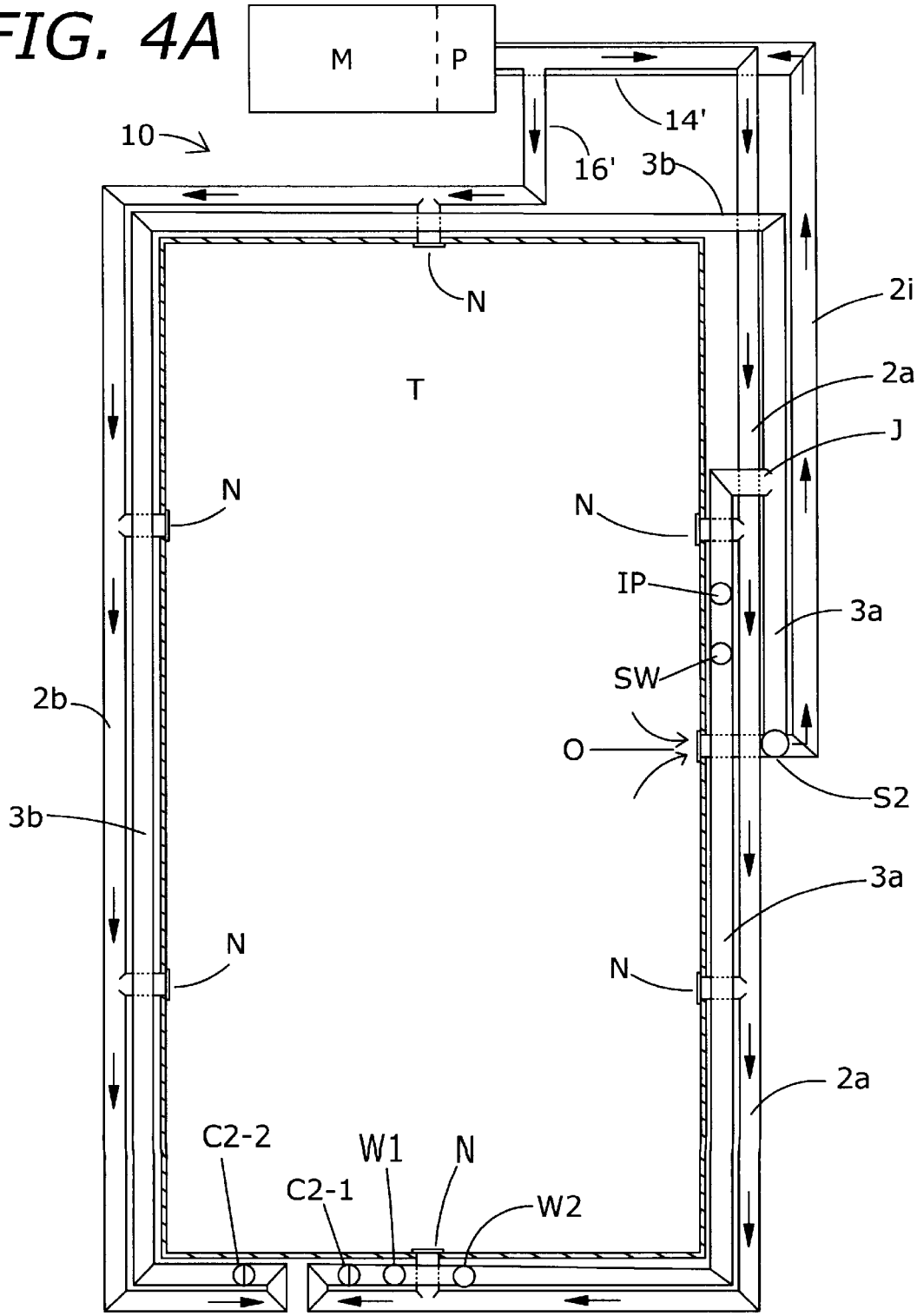
FIG. 4A is a schematic illustration of an embodiment of the water pipe circuit and air pipe circuit during the hydromassage operation mode with water flow shown by solid-line arrows.

FIGS. 4A and 4E presents a multi-loop embodiment analogous to that of FIGS. 1 and 2 in which the pump P provides pressurized water to two water circuit portions with water and air circuit flow loops formed on each side of the tub T during the cleaning operational mode. The use of systems with multiple flow loops allows the interior diameter of the pipes to be reduced, which is an advantage with regard to space around the tub T, production techniques, and production costs. More specifically, the outlet (unnumbered) of the pump P branches into a first outlet 14' and a second outlet 16' (analogous to the upper and lower outlets 14 and 16 of the embodiment of FIGS. 1 and 2). The outlet 14' connects to the water circuit 2*a* along the right side of the tub T and a portion of the lower edge of the tub T and terminates at a open/close valve C2-1. In a similar manner, the outlet 16' connects to the water circuit 2*b* along a portion of the top edge of the tub T, along the left side of the tub T, and along a portion of the bottom edge and terminates at an open/close valve C2-2. A water inlet pipe 2*i* leads from a suction valve S2 to the inlet (unnumbered) of the pump P. The air circuit portion 3*a* leads from the suction valve S2 along the right side of the tub T and along a portion of the lower edge of the tub T to terminate at the valve C2-1. The air circuit portion 3*b* branches from the air circuit 3*a* at a junction, generally indicated at J, and extends along the right side of the tub T, along a portion of the top edge of the tub T, along the left side of the tub T and terminates at the valve C2-2.

During the hydromassage mode of FIG. 4A, the valves C2-1 and C2-2 (which are both of the open/close type) are closed to separate the water and air circuits, and the suction valve S2 (shown in FIGS. 1E and 1F) is configured to allow water from the tub T to pass through the suction opening 0 through the water inlet pipe 2*i* to the inlet of the pump P while blocking communication between the air circuits and the inlet of the pump P. As shown on the left in FIG. 4A, water under pressure exits the pump P through outlet 16' and is conducted across the top of the tub T to the left and along the left side of the tub T to the closed valve C2-2 at the bottom of the tub T. The water is admixed with air from the air circuit 3*b* in each of the nozzles N on the left side of the tub T and then jetted into the tub T as is known in the art. In a similar manner and as shown on the right in FIG. 4A, water under pressure exits the pump P at outlet 14' and is conducted along the right side of the tub T to the closed valve C2-1 at the bottom of the tub T. The water is admixed with air from the air circuit 3*a* in each of the nozzles N on the right side of the tub T and then jetted into the tub T as is known in the art. Water in the tub T is sucked into and through the suction opening 0 where it is returned through water inlet pipe 2*i* to the inlet of the pump P for continued recirculation.

Figure 4B:
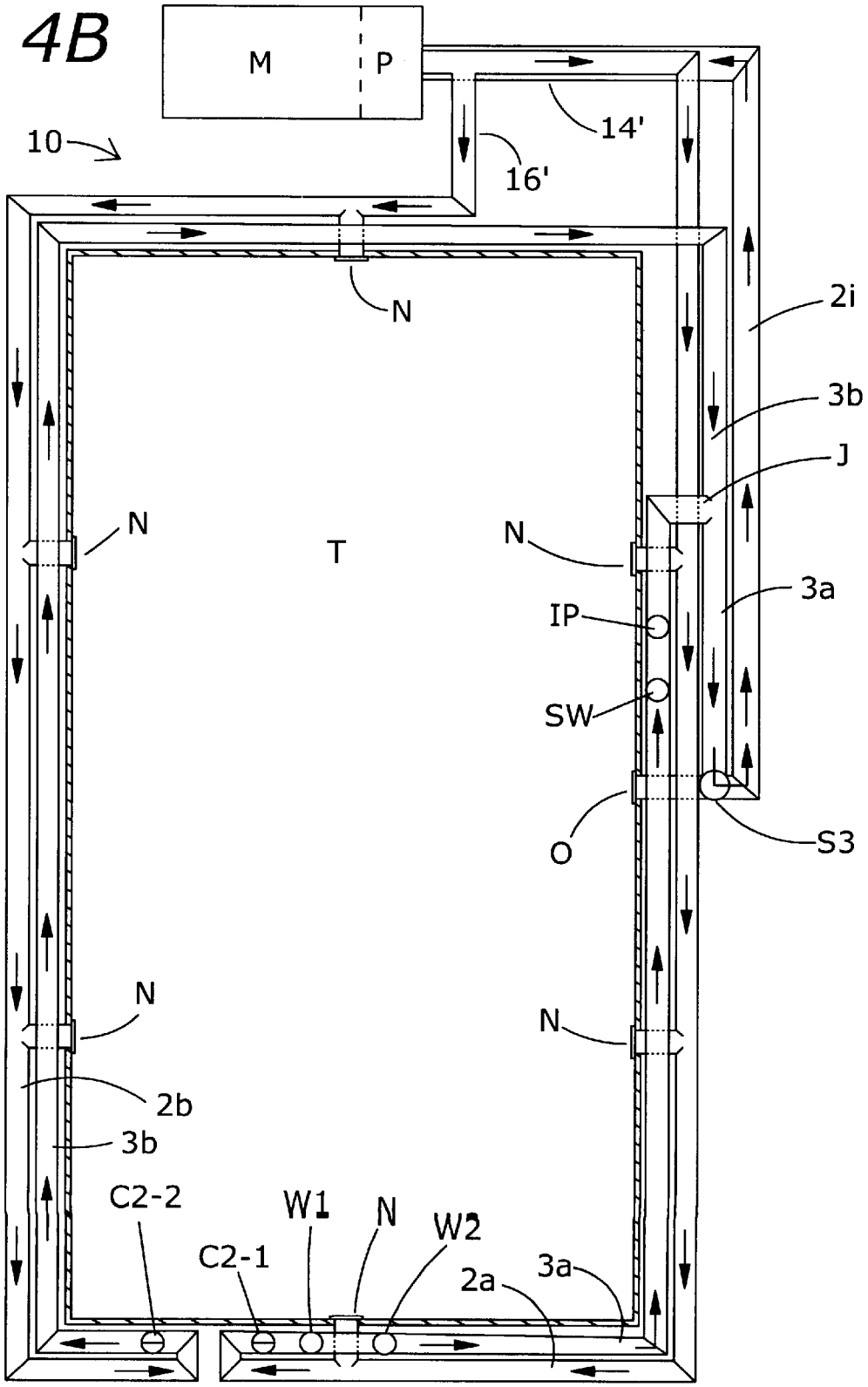
FIG. 4B is a schematic illustration of the embodiment of FIG. 4A during the cleaning operational mode in which water flow in both the water and the air circuits on each side of the tub are shown by solid-line arrows.

In the cleaning mode of FIG. 4B, the valves C2-1 and C2-2 are opened to allow flow between the water circuit 2*a* and the air circuit 3*a* on the right side of the tub T and allow flow between the water circuit 2*b* and the air circuit 3*b* on the left side of the tub T. The suction valve S2 is configured to allow flow between the air circuits 3*a* and 3*b* and the inlet of the pump P. As shown on the left in FIG. 4B and as indicated by the solid-line arrows, water under pressure exits the pump P at 16' and is conducted via the water circuit piping 2*b* along the left side of the tub T to the now-opened valve C2-2 and enters the air circuit 3*b* of the left-side of the tub T and flows along the left side of the tub T, across the top side, along the right side of the tub T to the valve S2. In a similar manner for the right side cleaning loop, water from the pump at outlet 14' flows along the right side of the tub T and across the bottom edge of the tub T to the now opened valve C2-1 to enter the air circuit 3*a*. loop. The water flow in the air circuit 3*a* then joins the water in the air circuit 3*b* at the junction J and flows through the valve S2 and the water inlet pipe 2*i* to the inlet of the pump P.

As can be appreciated from FIGS. 4A and 4B, the valves C2-1 and C2-2 selectively connect the water circuit portions 2*a* and 2*b* of each of the two cleaning loops to their respective air circuit portions 2*b* and 3*b* to allow flow therein while the valve S2 selectively connects the two air circuits 3*a* and 3*b* to the inlet of the pump P.

Figure 5A:
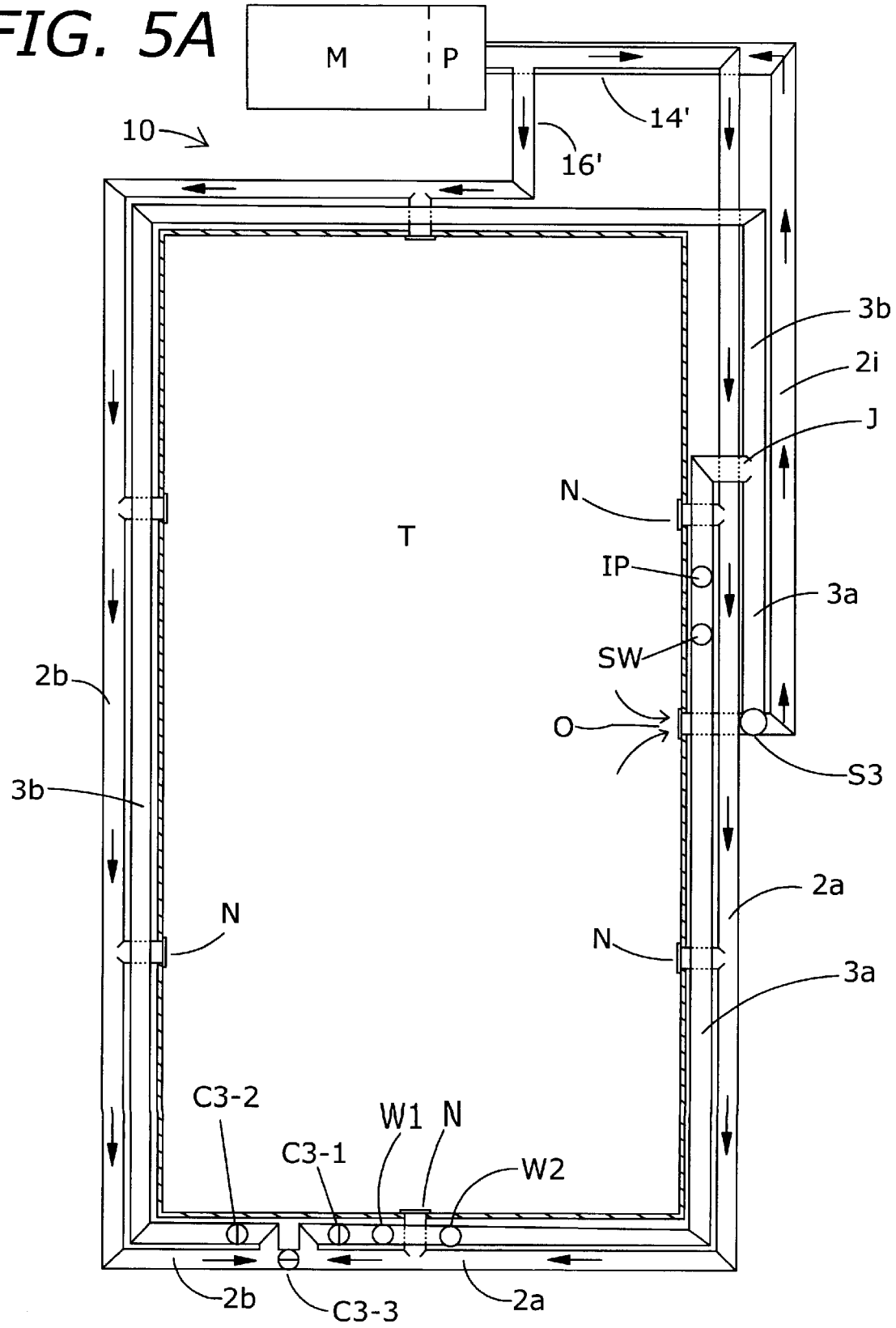
FIG. 5A is a schematic illustration of another embodiment of the water pipe circuit and air pipe circuit during the hydromassage mode with water flow shown by the solid-line arrows.
Figure 5B:
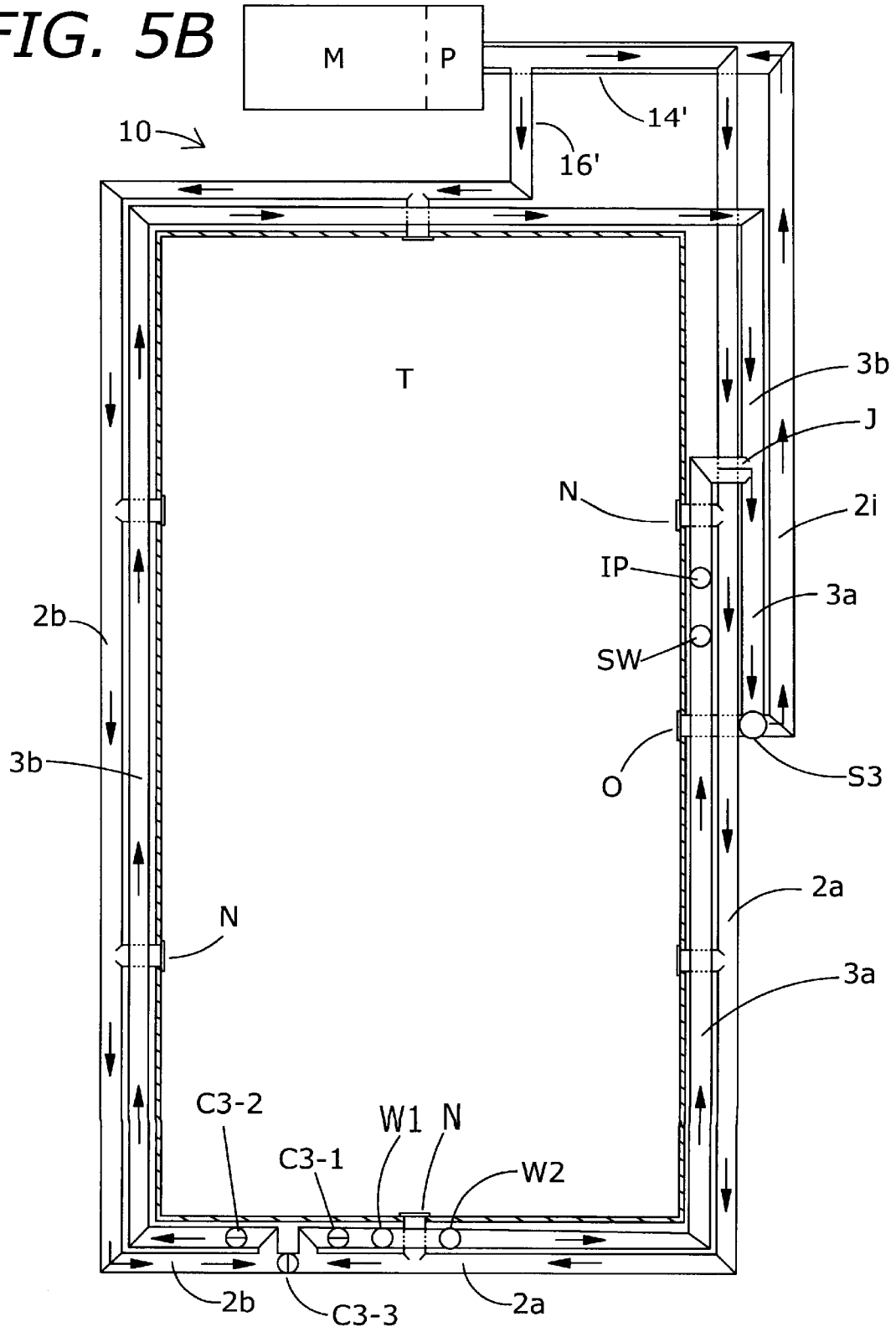
FIG. 5B is a schematic illustration of the configuration of FIG. 5A during the cleaning operational mode showing water flow in both the water and the air circuits and solid-line illustration.

FIGS. 5A and 5B illustrate a further embodiment similar to the embodiment of FIGS. 4A and 4B, but, in this case the water circuit is continuous during hydromassage operations. As in the case of the embodiment of FIGS. 4A and 4B, the pump P provides pressurized water to two water circuit portions 2*a* and 2*b* that are in flow communication through a third open/close valve. More specifically, the outlet (unnumbered) of the pump P branches into a first outlet 14' and a second outlet 16' (analogous to the upper and lower outlets 14 and 16 of the embodiment of FIGS. 1 and 2). The outlet 14' connects to the water circuit 2*a* along the right side of the tub T and a portion of the lower edge of the tub T. In a similar manner, the outlet 16' connects to the water circuit 2*b* along a portion of the top edge of the tub T, along the left side of the tub T, and along a portion of the bottom edge and joins with the water circuit portion 2*a*. A third open/close valve C3-3 is interposed in the water circuit at the junction of the water circuit portions 2*a* and 2*b*. A water inlet pipe 2*i* leads from a suction valve S3 to the inlet (unnumbered) of the pump P. The air circuit portion 3*a* leads from the suction valve S3 along the right side of the tub T and along a portion of the lower edge of the tub T to join the water circuit. In a similar manner, the air circuit portion 3*b* branches from the air circuit 3*a* at junction point J along the right side of the tub T and leads along a portion of the top edge of the tub T, along the left side of the tub T and also connects to the water circuit. An open/close valve C3-1 is in the flow path between the air circuit portion 3*a* and the water circuit portion 2*a*, and, similarly, an open/close valve C3-2 is in the flow path between the air circuit portion 3*b* and the water circuit portion 2*b*.

In the hydromassage mode of FIG. 5A, the valves C3-1 and C3-2 in, respectively, the air circuit portions 3*a* and 3*b* are closed to isolate the air circuit 3 from the water circuit 2 while the valve C3-3 is opened to allow fluid communication between the water circuit 2*b* piping of the left side and the water circuit 2*a* piping on the right side of the tub T. Other than the fluid communication consequent to the open valve C3-3, the operation of the embodiment of FIG. 5A is the same as that described for FIG. 4A, above.

In the cleaning mode of FIG. 5B, the valve C3-3 is closed to interrupt communication between the water circuit 2*a* and 2*b* on the left and right side of the tub T while the valves C3-1 and C3-2 are opened to allow communication between the water circuits 2*a* and the air circuit 3*a* on the right side of the tub T and the water circuit 2*b* and the air circuit 3*b* on the left side of the tub T. Additionally, the suction valve S3 is adjusted to provide flow communication between the air circuit portions and the water inlet pipe 2*i* to the inlet of the pump P. With the valve C3-3 closed, the operation of the organization of FIG. 5B is the same as that of FIG. 4B.

Figure 6A:
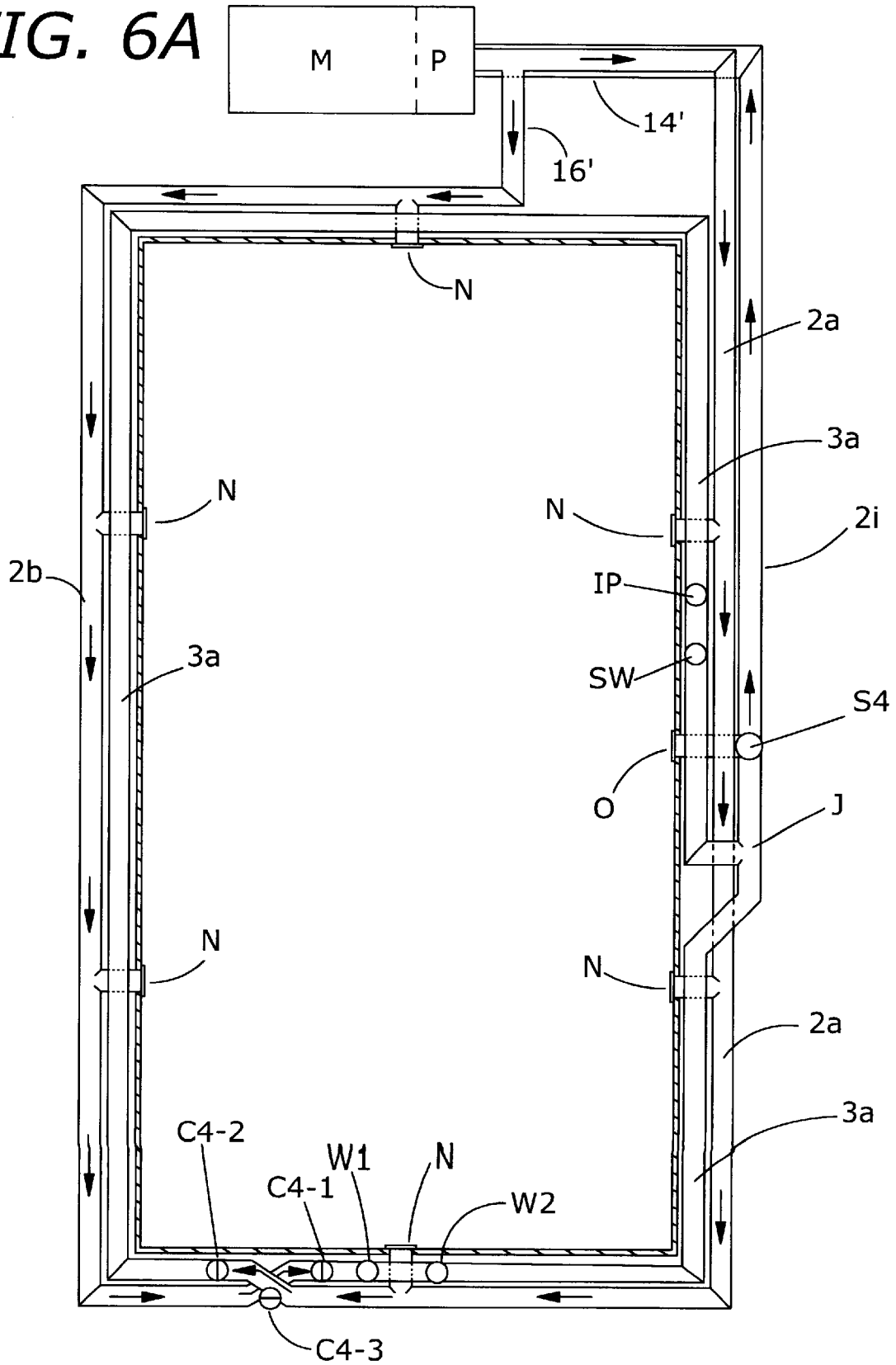
FIG. 6A is schematic illustration of yet another embodiment showing the water pipe circuit and air pipe circuit during the hydromassage mode.
Figure 6B:
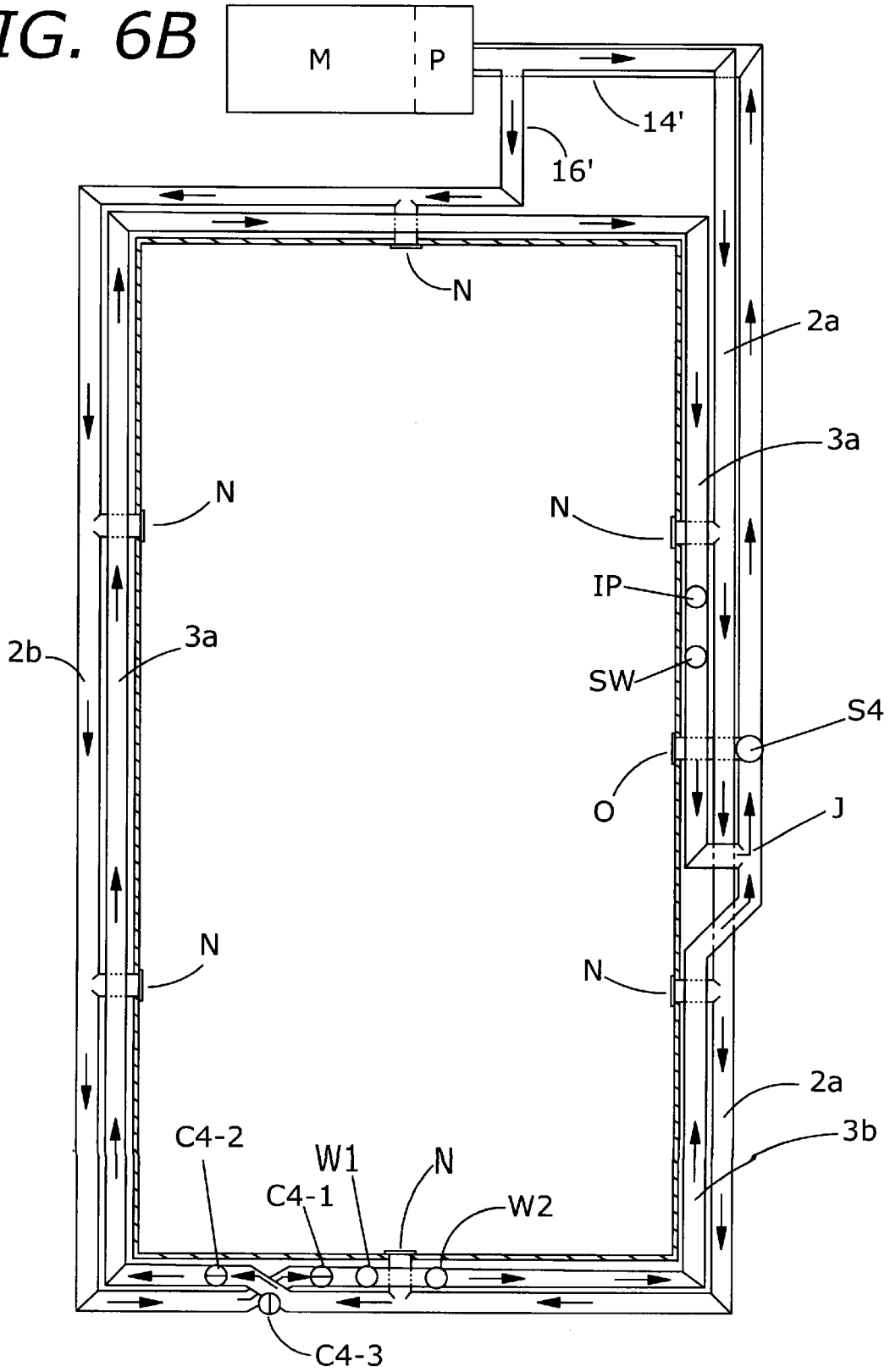
FIG. 6B is schematic illustration of the embodiment of FIG. 6A showing the water pipe circuit and air pipe circuit during the cleaning operational mode with water flow in both the water and the air circuits shown by solid-line arrows.

FIGS. 6A and 6B illustrate yet another embodiment of the present invention in which the water and air circuits are similar to the embodiment according to FIGS. 4A and 4B, but in which the water circuit portion and air circuit portion of each loop created in the cleaning mode are on opposite sides of the tub T rather than being on the same side of the tub T as in the case of the embodiments of FIGS. 1–2, 4A–4B, and 5A–5B. Thus, in the case of the ebodiment of FIGS. 6A and 6B and in contrast to the embodiments of FIGS. 1–2, 4A–4B, and 5A–5B, the air circuit portion 3*b* is located on the right side of the tub T, and the air circuit portion 3*a* is located on the left side of the tub T.

In the embodiment of FIGS. 6A and 6B, the water circuit portion 2*b* on the left side of the tub T receives its supply of pressurized water from the outlet 16' of the pump P and connects through an open/close valve C4-1 to the air circuit portion 3*b* now located on the right side of the tub T. The air circuit portion 3*b* connects to a suction valve S4. Conversely, water circuit portion 2*a* on the right side of the tub T receives its supply of pressurized water from the outlet 14' of the pump P and connects through an open/close valve C4-2 to the air circuit portion 3*a* now located on the left side of the tub T. The air circuit portion 3*a* extends from the left side of the tub T along the top edge and the right side of the, tub T where it joins the air circuit portion 3*b* at a junction J for connection to the suction valve S4. The valve C4-3 is shown in schematic fashion in the lower part of FIGS. 6A and 6B connects the water circuit pipes on the opposite sides of the tub T. Other than the differences relating to the connection between the water supply and air supply pipes, the operation of the embodiment of FIGS. 6A and 6B in the hydromassage and the cleaning mode is the same as that for FIGS. 5A and 5*b*. In the embodiment of FIGS. 6A and 6B, less resistance in the water flow is achieved.

In a fifth embodiment (not shown) similar to the embodiments according to FIGS. 3–6, a cleaning circuit has been formed by means of valves and pipe connections, the cleaning circuit including the circuit of an air massage system. This provides an advantage for whirlpool baths which use a combination of a water massage system and an air massage system.

As will be apparent to those skilled in the art, various changes and modifications may be made to the illustrated cleaning system for hydromassage baths of the present invention without departing from the spirit and scope of the invention as determined in the appended claims and their legal equivalent.

What is claimed is:

1. A hydromassage tub system having a hydromassage mode and a cleaning mode of the type having a tub with a plurality of nozzles therein for introducing water jets into the interior of the tub and a pump for supplying pressurized water to the nozzles, comprising:

a water circuit connected to the nozzles for supplying water under pressure thereto;

a pump connected to said water circuit for supplying pressurized water thereto, said pump having an inlet for receiving water to be pressurized for supply to said water circuit;

an air circuit in flow communication with said nozzles for distributing air thereto in the hydromassage mode;

first valve means for selectively connecting the pump inlet to a suction inlet in the tub for accepting water from the interior of the tub in the hydromassage mode and for selectively connecting said pump inlet to said air circuit for accepting water therefrom in the cleaning mode; and a second valve for selectively connecting the water circuit to the air circuit in the cleaning mode at a position in the water circuit to define a first water circuit portion having at least one nozzle therein and a second water circuit portion having at least one nozzle therein and to define a first air circuit portion and a second air circuit portion, said first water circuit portion and said second water circuit portion not in flow communication through said second valve when in the cleaning mode and defining, when in the cleaning mode, a first flow circuit portion in which water flows in said first water circuit portion and through said first portion of said air circuit and through said first valve means to the said pump inlet and a second flow circuit portion in which water flows in said second water circuit portion through said second portion of said air circuit and through said first valve means to said pump inlet.

2. The hydromassage tub system of claim 1, wherein said second valve, when connecting said water circuit to said air circuit in the cleaning mode, defines the first air circuit portion connected from said second valve to said first valve means and defines the second air circuit portion from said second valve to said first valve means, said first and second air circuit portions extending in parallel flow communication from said second valve to said first valve means.

3. The hydromassage tub system of claim 2, wherein said tub has a first lateral side and a second lateral side, said first water circuit portion and said first air circuit portion located on one side of said tub and said second water circuit portion and said second air circuit portion located on the other side of said tub, said second valve, when in the cleaning mode, connecting the water circuit portion on one side of said tub to said first air circuit portion on the one side of said tube and connecting the second water circuit portion on the other side of said tub to the second air circuit portion on that other side of said tub.

4. The hydromassage tub system of claim 2, wherein said second valve, when in the cleaning mode, interrupts said water circuit to define said first and second water circuit portions and interrupts said air circuit to define said first and second air circuit portions.

5. The hydromassage tub system of claim 4, wherein said second valve comprises a valve body having first and second through flow passages for providing, respectively, flow communication for the water circuit and the air circuit in the hydromassage mode therethrough and first and second shunt flow passages for providing, respectively, flow communication between the first water circuit portion and a one of the air circuit portions and between the second water circuit portion and the other of the air circuit portions during the cleaning mode.

6. The hydromassage tub system of claim 1, wherein said first valve means comprises a three-port two-position valve for selectively connecting the suction inlet to the inlet of said pump in one position and for selectively connecting the air circuit to the inlet of said pump in the second position.

7. A hydromassage tub system having a hydromassage mode and a cleaning mode of the type having a tub with a plurality of nozzles therein for introducing water jets into the interior of the tub, comprising:

a first group of at least one nozzle and a second group of at least one nozzle for introducing water into the interior of the tub;

a water circuit in flow communication with said nozzles for supplying water under pressure thereto;

an air circuit in flow communication with said nozzles for distributing air thereto in the hydromassage mode;

a pump having at least one outlet connected to said water circuit for supplying pressurized water thereto, said pump having an inlet for receiving water to be pressurized for supply to said water circuit;

first valve means for selectively connecting said pump inlet to a suction inlet in the tub for accepting water from the interior of the tub in the hydromassage mode and for selectively connecting said pump inlet to said air circuit for accepting water therefrom in the cleaning mode; and second valve connected to said water circuit and said air circuit at a position intermediate said first and said second groups of nozzles to define first and second water circuit sub-portions and define first and second air circuit sub-portions, said first air circuit sub-portion extending between said second valve and said first valve means and said second air circuit sub-portion extending between said second valve and said first valve means, said first and second water circuit sub-portions not in flow communication through said second valve when in said cleaning mode, said second valve, when in the cleaning mode, connecting said first water circuit sub-portion to one of said first or second air circuit sub-portions through said second valve and connecting said second water circuit sub-portion to the other of said first or second air circuit sub-portions through said second valve to define a first cleaning path in which water flows from said pump through said first water circuit sub-portion and said second valve through said one of said first or second air circuit sub-portions and through said first valve means to said pump inlet and a second cleaning path in which water flows from said pump through said second water circuit sub-portion through said second valve through the other of said first or second air circuit sub-portions and through said first valve means to said pump inlet.

8. The hydromassage tub system of claim 7, wherein said second valve, when in the cleaning mode, interrupts flow communication in said water circuit thereat to define said first water circuit sub-portion and said second water circuit sub-portion and interrupts flow communication in said air circuit thereat to define said first air circuit sub-portion and said second air circuit sub-portion.

9. The hydromassage tub system of claim 8, wherein said second valve comprises a valve body having first and second through flow passages for providing, in the hyrdomassage mode, flow communication for the water circuit and the air circuit therethrough and having first and second shunt flow passages for providing, in the cleaning mode, flow communication between the first water circuit sub-portion and the first air circuit sub-portion and flow communication between the second water circuit sub-portion and the second air circuit sub-portions.

10. The hydromassage tub system of claim 7, wherein said tub has a first side and a second side, said first water circuit sub-portion and said first air circuit sub-portion located on one side of said tub and said second water circuit sub-portion and said second air circuit sub-portion located on the second side of said tub, said second valve, when in the cleaning mode, connecting the water circuit sub-portion on said first side of said tub to the air circuit sub-portion on said first side of said tub and connecting the water circuit sub-portion on the second side of said tub to the air circuit sub-portion on said second side of said tub.

11. The hydromassage tub system of claim 7, wherein said first valve means comprises a three-port two-position valve for selectively connecting the suction inlet to the inlet of said pump in one position and for selectively connecting the air circuit to the inlet of said pump in the second position.

* * * * *